United States Patent [19]

Paque

[11] Patent Number: 5,022,771

[45] Date of Patent: Jun. 11, 1991

[54] THERMAL PRINTING APPARATUS AND TAPE SUPPLY CARTRIDGE THEREFOR

[75] Inventor: Michael W. Paque, Scottsdale, Ariz.

[73] Assignee: Kroy Inc., Scottsdale, Ariz.

[21] Appl. No.: 381,057

[22] Filed: Jul. 17, 1989

[51] Int. Cl.[5] ..... B41J 3/02; B41J 35/28

[52] U.S. Cl. ..... 400/120; 400/208; 400/613; 400/621; 156/387; 156/DIG. 49

[58] Field of Search ..... 400/613, 120, 207, 208, 400/208.1, 248, 619, 621, 615.2, 134.1, 134.5; 156/384, 386, DIG. 49, 510

[56] References Cited

U.S. PATENT DOCUMENTS

| | | | |
|---|---|---|---|
| 3,834,507 | 9/1974 | Bradshaw | 400/134.6 |
| 4,226,547 | 10/1980 | Bradshaw et al. | 400/613 |
| 4,243,333 | 1/1981 | Bradshaw | 400/613 |
| 4,391,539 | 7/1983 | Connoy | 400/208 |
| 4,402,619 | 9/1983 | Paque et al. | 400/208 |
| 4,624,590 | 11/1986 | Richardson et al. | 400/120 |
| 4,666,319 | 5/1987 | Hiroshaki et al. | 400/120 |
| 4,678,353 | 7/1987 | Richardson et al. | 400/208 |
| 4,815,874 | 3/1989 | Richardson et al. | 400/208 |
| 4,815,875 | 3/1989 | Richardson et al. | 400/208 |
| 4,832,514 | 5/1989 | Basile | 400/120 |
| 4,917,514 | 4/1990 | Richardson et al. | 400/120 |
| 4,924,242 | 5/1990 | Fukawa | 400/120 |
| 4,927,278 | 5/1990 | Kuzuya et al. | 400/208 |
| 4,966,476 | 10/1990 | Kuzuya et al. | 400/120 |

*Primary Examiner*—Eugene M. Eickholt
*Attorney, Agent, or Firm*—Dorsey & Whitney

[57] ABSTRACT

A thermal printing device and tape supply cartridge therefor which includes a printing mechanism having a print head incorporated within the machine and a separate printing platen embodied within the cartridge. An alignment mechanism is also provided for insuring printing alignment between the cartridge embodied platen and the print head. The cartridge also includes a mechanism for laminating a film of protective material over the printed tape and a fully incorporated, manually operated tape cut-off mechanism.

18 Claims, 6 Drawing Sheets

THERMAL PRINTING APPARATUS AND TAPE SUPPLY CARTRIDGE THEREFOR

BACKGROUND OF THE INVENTION

1. Field of the Invention

The present invention relates generally to a thermal printing device and a tape supply cartridge therefor, and more particularly, to a thermal device for generating an image of characters on, or for transferring an image of characters from a strip of color carrying ribbon to, an image carrying tape as the result of the localized application of heat and pressure. The invention also relates to an improved tape or tape-ribbon supply cartridge usable with such a device which embodies a cartridge contained platen, an improved tape cut-off feature and means providing a protective laminate onto the printed tape.

2. Description of the Prior Art

A variety of strip printing or transfer type devices which are utilized to transfer characters from a strip of color carrying ribbon to a strip of image carrying tape currently exist in the prior art. One such device employs impact or pressure in combination with a font having raised characters to transfer an image of a selected character from a ribbon to an image receiving tape. These so-called impact or pressure lettering devices have existed since the mid-1970's and are described in U.S. Pat. Nos. 3,834,507; 4,243,333; 4,402,619 and 4,624,590, among others. Cartridges for supplying tape and ribbon to these devices are described in U.S. Pat. Nos. 4,226,547; 4,391,539 and 4,678,353, among others.

Printing or transfer devices also exist in which an image of a desired character is formed onto a strip of image carrying tape by transferring ink or other color from a color carrying ribbon to such tape as a result of the localized application of heat and a small amount of pressure. A typical thermal transfer device of this type is described in U.S. Pat. No. 4,666,319 dated May 19, 1987 and issued to Hirosaki et al.

Other thermal transfer devices which currently exist employ a machine for transferring the image of a desired character from a strip of ribbon to a strip of tape and a cooperating tape-ribbon cartridge usable with the device for providing a supply of tape and ribbon to the machine transfer station. In these devices, the cartridge is positioned relative to the main machine such that operative printing or transfer components of the machine are positioned on opposite sides of the tape or tape-ribbon during the printing or transfer operation. Such a machine and cartridge is described in U.S. Pat. No. 4,815,875 dated Mar. 28, 1989 issued to Richardson et al.

U.S. Pat. No. 4,815,874 dated Mar. 28, 1989 and issued to Richardson et. al. is a related patent and is directed to a thermal printer and tape-ribbon cartridge with an improved cut-off mechanism. The specific cut-off mechanism disclosed in this patent includes a cut-off blade or edge embodied within the cartridge and a actuating arm or lever from the machine which interfaces with such blade or edge to perform the tape cut-off function.

Although the above described devices and corresponding cartridges have been satisfactory for various uses and applications, there is always a need to improve the quality of the image transfer, to reduce the amount of user maintenance and to simplify the printing or transfer process. Accordingly, there is a continued need for improvements in thermal printing and transfer devices and associated cartridges for supplying tape or tape and ribbon thereto.

SUMMARY OF THE INVENTION

In accordance with the present invention, a thermal printing device or system is provided in which an image of a desired character is generated on, or is transferred from a strip of color carrying ribbon to, a strip of image carrying tape. Generally, such a system includes a printing or transfer station defined by a printhead and a platen and means for advancing the tape or the tape and ribbon from a supply cartridge to the printing or transfer station. The device of the present invention includes a tape receiving cavity or portion for receiving the tape or tape and ribbon supply cartridge and retaining the same in operative printing or transfer alignment. The device is provided with an integral keyboard and a hinged cover for protecting the keyboard when the device is not in use. The device is also provided with a printhead which is interfaceable with a corresponding platen embodied within the cartridge for performing the printing or transfer step and a platen alignment post.

The tape or tape-ribbon supply cartridge of the present invention, in contrast to the prior art devices, is provided with a portion of the operative printing mechanism, namely, a rotatable platen which is designed to interface with the machine printhead to perform the print or transfer function. Such a structure virtually eliminates printing quality problems normally caused by platen damage or wear. Also, because a new platen is provided each time a cartridge is replaced, user maintenance and cleaning of the platen is also eliminated. Further, because the printhead is embodied within the machine and the cooperating platen is incorporated within the cartridge, means are also provided in the form of a platen alignment post for insuring proper alignment between the printhead and the platen when the cartridge is inserted. Still further, because the platen is provided in the cartridge itself, the particular characteristics of the platen can change, from cartridge to cartridge, to fit the tape and ribbon parameters and the particular printing application.

The tape or tape-ribbon supply cartridge of the present invention is also provided with an improved, manually operated tape cut-off mechanism incorporated solely within the cartridge, without machine interface. Such cut-off feature provides for a simpler machine/-cartridge combination than exists in the prior art while also providing the advantages of a cartridge embodied cut-off device. These advantages principally include the existence of a new cut-off blade each time a cartridge is replaced, thereby eliminating any maintenance or other time to replace, repair or sharpen the tape cutting blades.

Accordingly, it is an object of the present invention to provide an improved thermal printing device or the like for generating the desired character on, or for transferring a desired character from a strip of ribbon to, a strip of tape.

Another object of the present invention is to provide a thermal printing or transfer device or the like having an improved thermal printing or transfer mechanism.

A further object of the present invention is to provide a thermal printing or transfer device embodying a printhead and corresponding platen in which the printhead is incorporated into the machine and the corresponding platen is embodied within a tape supply cartridge.

A further object of the present invention is to provide a tape or tape-ribbon cartridge usable with a thermal printing or transfer device or the like and having a mechanism for aligning the cartridge embodied platen relative to the printhead.

Another object of the present invention is to provide a tape or tape-ribbon supply cartridge having means for providing a protective laminate over the printed tape.

A further object of the present invention is to provide a tape or tape-ribbon supply cartridge having an improved tape cut-off mechanism embodied solely within the cartridge.

Another object of the present invention is to provide a combination machine and cartridge having features of the type described above.

These and other objects of the present invention will become apparent with reference to the drawings, the description of the preferred embodiment and the appended claims.

DESCRIPTION OF THE PREFERRED EMBODIMENT

Figure 1:
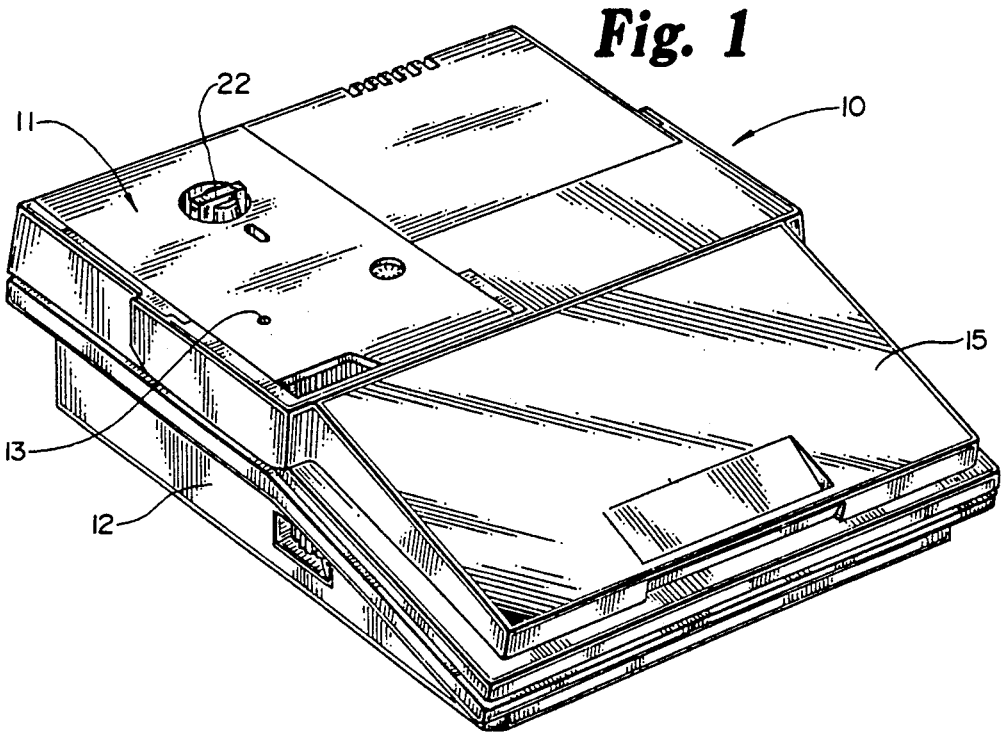
FIG. 1 is a perspective view of the thermal printing device of the present invention in its transport position with a tape supply cartridge therein.

As described generally above, the present invention relates to a thermal printing or transfer device and an associated tape supply cartridge. Although the preferred embodiment illustrated in the drawings and described below relates to a thermal transfer device and an associated tape-ribbon supply cartridge in which the image of a character is transferred at a transfer station from the ribbon to a strip of tape, it is also contemplated that the present invention relates to various other lettering apparatus and strip printers as well. For example, without limitation, it is contemplated that the features of the present invention are applicable to various types of thermal printing devices other than a thermal transfer device, such as a thermal printing device in which characters are generated on a strip of thermal tape rather than transferred from a ribbon. In such a device, the tape is treated with certain thermal materials so that when heat is applied, an image is formed. This eliminates the need for a ribbon supply. Throughout the specification and claims, the term thermal printing device is intended to include both a thermal device in which characters are formed directly onto specially treated thermal tape as well as a thermal transfer device in which characters are transferred to such tape from a ribbon member.

Figure 2:
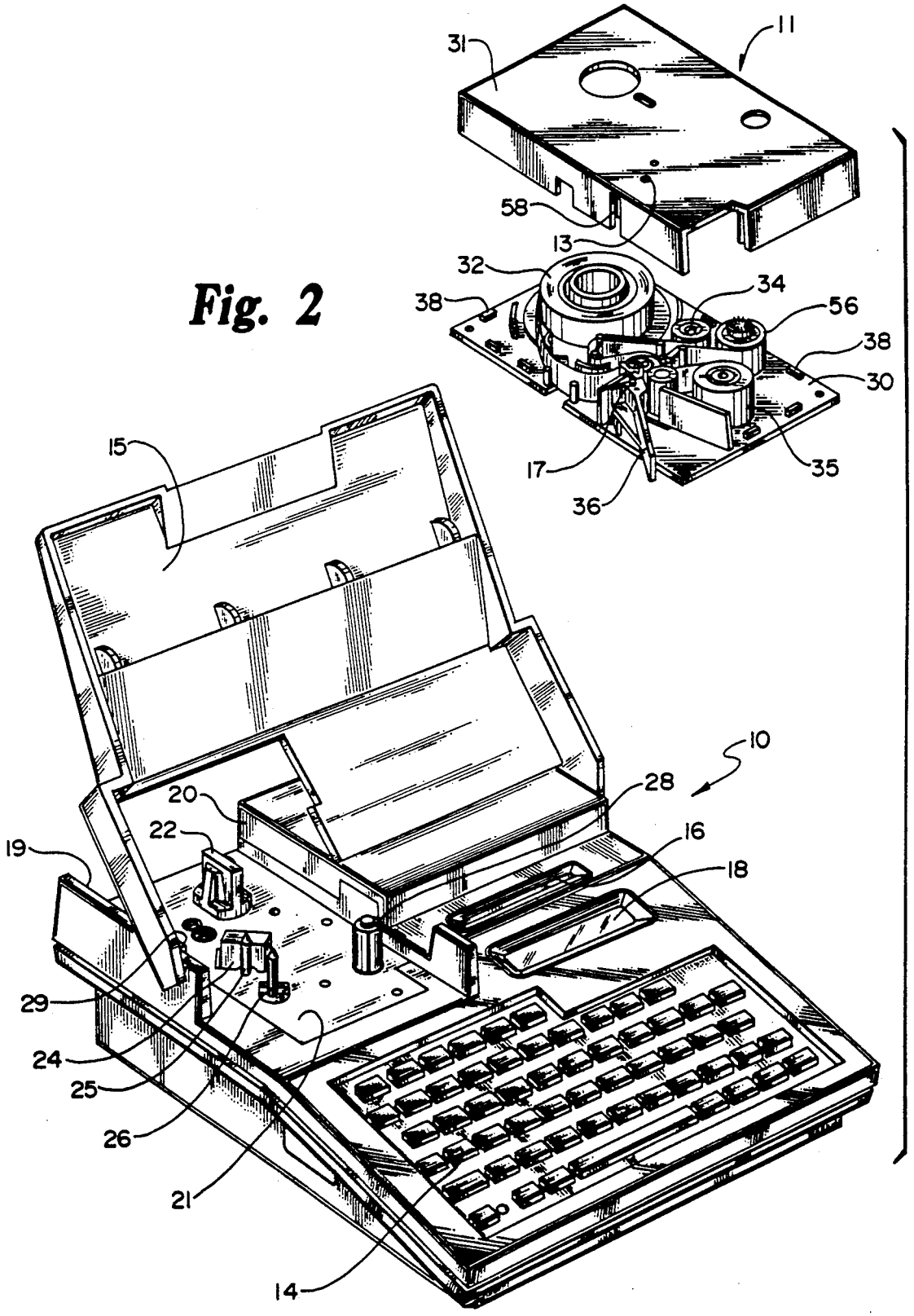
FIG. 2 is an exploded perspective view showing the thermal device of the present invention in its use position with the cover opened and the cartridge removed with the cartridge cover raised.

General reference is first made to FIGS. 1 and 2 illustrating the preferred embodiment of a thermal transfer apparatus and associated tape-ribbon cartridge in accordance with the present invention. The thermal transfer machine illustrated generally by the reference numeral 10 includes a main housing portion 12, a keyboard 14 (FIG. 2) and a hinged cover 15. The hinged cover 15 can be selectively raised during use to expose the keyboard 14 as shown in FIG. 2 or closed when the machine is not in use or is in transport, to cover the keyboard 14. The cover 15 is hinged with respect to side portions of the housing 12 by an appropriate spindle or post and opening. The machine 10 also includes a circuit board or magnetic card slot 16 and a display window 18 to display the text being generated or other information for the user.

Formed within a portion of the machine housing 12 is a cartridge receiving cavity defined on its sides by the wall sections 19 and 20 and on its bottom by the stage or bottom support surface 21. Included within the cartridge receiving cavity as illustrated generally in FIG. 2 and which will be described in greater detail below, is a cartridge locking knob 22, a printhead 24, a fixed platen alignment and support post 25, a laterally fixed drive and lamination roller alignment and support post 26, a ribbon takeup spindle 28 and a tape sensor 29.

The cartridge 11 generally includes a base plate 30 and cover 31 as well as various internal components including, among others, a tape supply 32, a ribbon supply 34, a lamination film supply 35 and a tape cut-off lever 36. When assembled, the cover 31 is connected and aligned with respect to the base plate 30 by the alignment and connecting members 38. The cover 31 is retained to the base 30 via adhesive, sonic welding or other appropriate and conventional means. In its assembled form, the cartridge 11 is received by the cartridge cavity in the form illustrated in FIG. 1. The cartridge 11 is then locked into an operative position by rotating the locking knob 22 to the position illustrated in FIG. 1 and described below.

Figure 4:
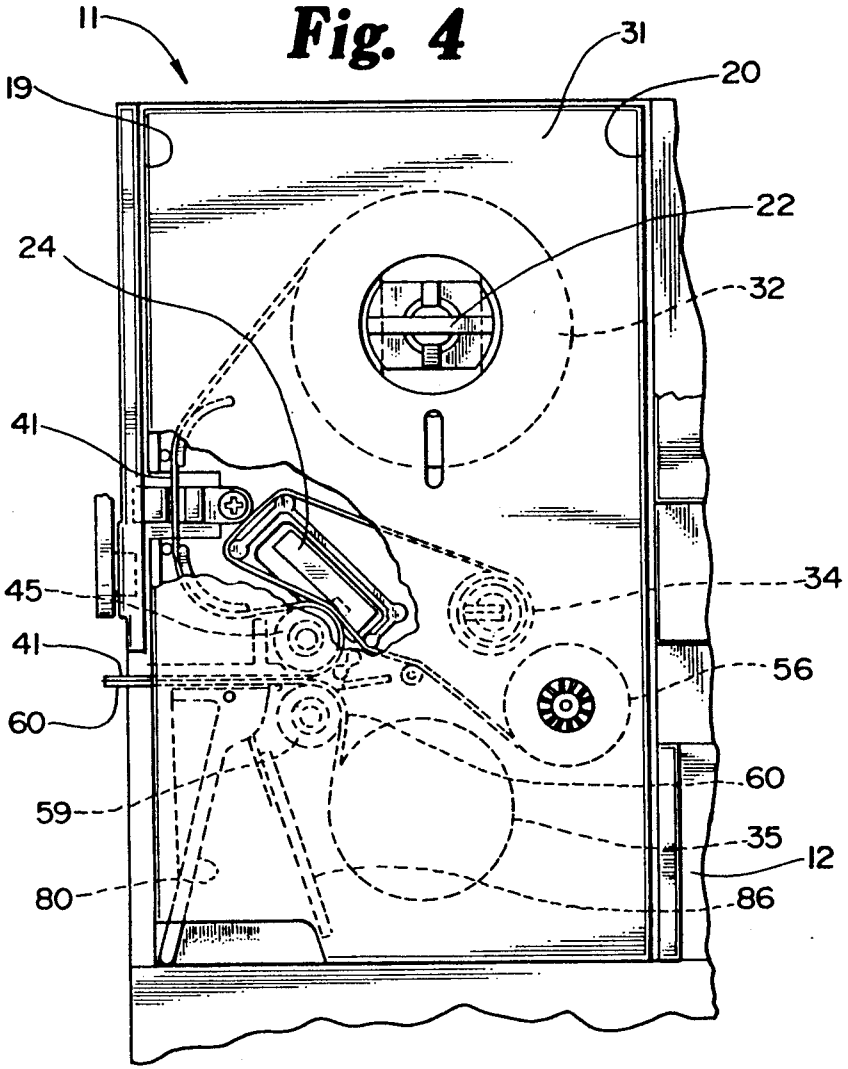
FIG. 4 is a fragmentary top plan view of the thermal device of the present invention and the cartridge with parts cut away.
Figure 3:
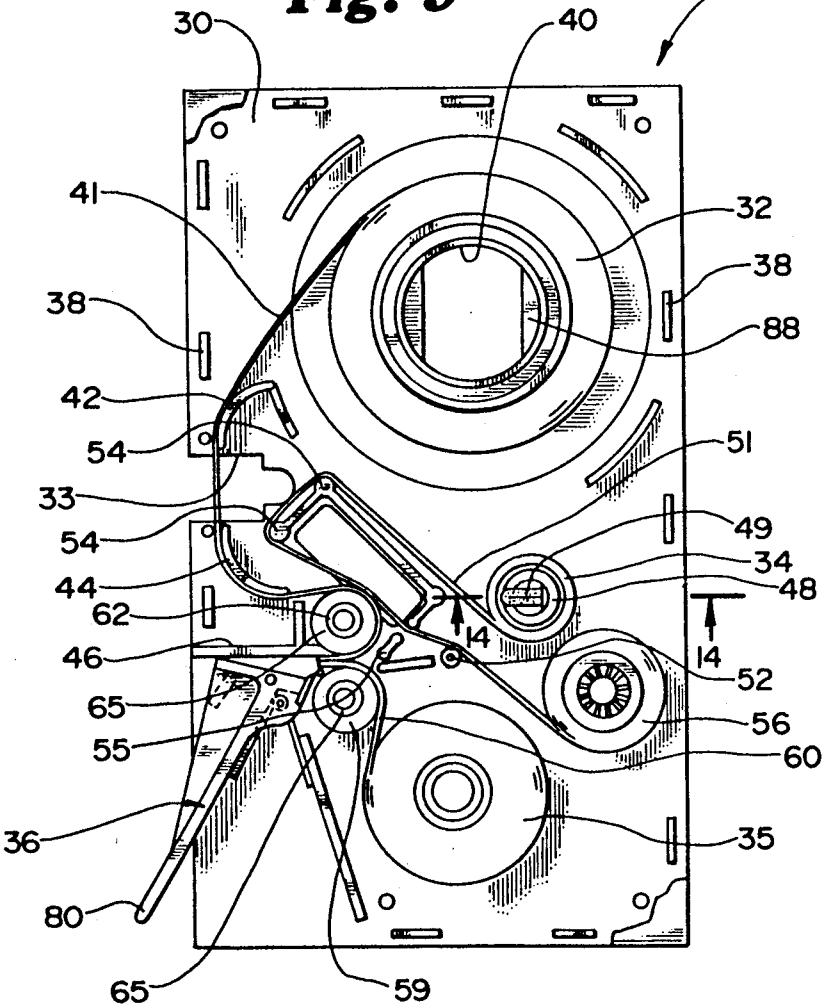
FIG. 3 is a top plan view of the tape supply cartridge with parts cut away.

Reference is next made to FIGS. 3 and 4 showing various details of the tape-ribbon cartridge assembly. FIG. 3 is a top plan view of the cartridge 11 with the cover removed, while FIG. 4 is a top plan view of a cartridge in operative position within the machine, showing, in broken lines, the various operative components of the cartridge in their operative condition.

Figure 14:
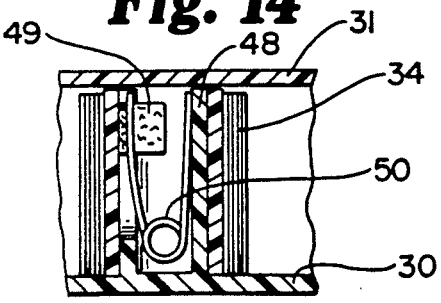
FIG. 14 is a sectional view showing the details of the ribbon spool support as viewed along the section line 14—14 of FIG. 3.

The tape supply spool 32 is mounted within the cartridge relative to a generally cylindrical tape support wall whose inner surface defines a generally cylindrical tape spool well 40. The tape supply spool 32 provides a supply of tape 41 which extends around the tape guide 42, past the tape sensor window 33, around the tape guide 44 and then around the generally cylindrical idler or platen roller 45. The ribbon is supplied from a ribbon supply spool 34 which is in turn mounted to a ribbon supply post 48 integrally secured to the cartridge base 30. A felt strip friction drag element 49 is mounted within the post 48 as illustrated in FIG. 14 and is biased by the spring member 50 (FIG. 14) to bias the felt strip 49 against the ribbon supply spool to exert a friction drag thereon. The ribbon supply 34 provides a supply of transfer ribbon 51 around a pair of ribbon guide posts 54, 54 and then around the platen roller 45 where it engages, in face to face registration with the tape 41. While the tape 41 and ribbon 51 are engaged with one another around the platen 45, the thermal transfer printhead 24 (FIG. 4) is moved into printing or transfer position to exert the necessary heat and pressure in order to transfer a selected image from the ribbon 51 to the tape 41. This transfer process is well-known in the art.

After passing the platen roller 45, the ribbon 51 is stripped from the printed surface of the tape 41 and pulled around the ribbon takeup guide post 55 and then around the roller 52, after which it is wound onto a ribbon takeup spool 56. The tape 41 continues around the platen 45 and passes outwardly through an exit opening 58 (FIG. 2) in the side wall of the cartridge cover. As the printed tape 41 passes between the platen 45 and the drive and lamination roller 59, a strip of laminating or protective film 60 is secured to the printed surface of the tape 41. The laminating film 60 is supplied from the spool of laminating material 35. Following the lamination step which occurs between the platen roller 45 and the roller 59, the laminated and printed tape moves along the tape cut-off wall 46 and exits from the cartridge through the tape opening 58 (FIG. 2).

In the preferred embodiment, the platen 45 is a generally annular component mounted about a generally cylindrical sleeve 62. As illustrated best in FIG. 11, the lower end of the sleeve 62 extends into an appropriate opening in the base 30 of the cartridge to retain the same in a desired position. The sleeve 62 includes an outwardly extending flange portion 64 near its lower end to support the platen 45. In the preferred embodiment, the platen portion 45 is constructed of a urethane or a thermal plastic elastomer material, with a durometer of between about Shore A 35 and Shore A 60. It is contemplated, however, that various other materials may be used as well. The internal cylindrical surface of the sleeve 62 is designed to be inserted over and to be guided and aligned by the platen roller alignment post 25 which is fixed relative to the machine. This relationship between the post 25 and the machine is illustrated best in FIGS. 2, 8 and 11. It should be noted that having the platen in the cartridge facilitates the optimizing of the roller parameters (hardness, etc.) to specific ribbon and tape characteristics and particular printing applications.

Figure 9:
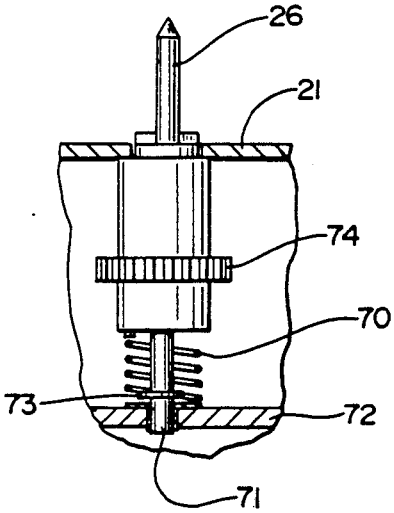
FIG. 9 is a fragmentary side elevational detail with selected parts shown in section of the alignment post for the lamination roller.
Figure 8:
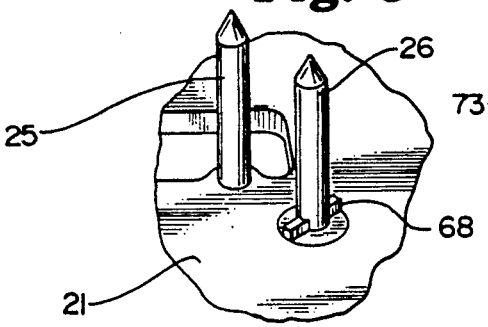
FIG. 8 is a fragmentary perspective detail showing the alignment posts for the platen roller and the drive and lamination roller.
Figure 10:
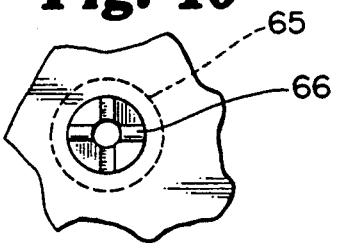
FIG. 10 is a fragmentary bottom plan detail of the lamination roller.
Figure 11:
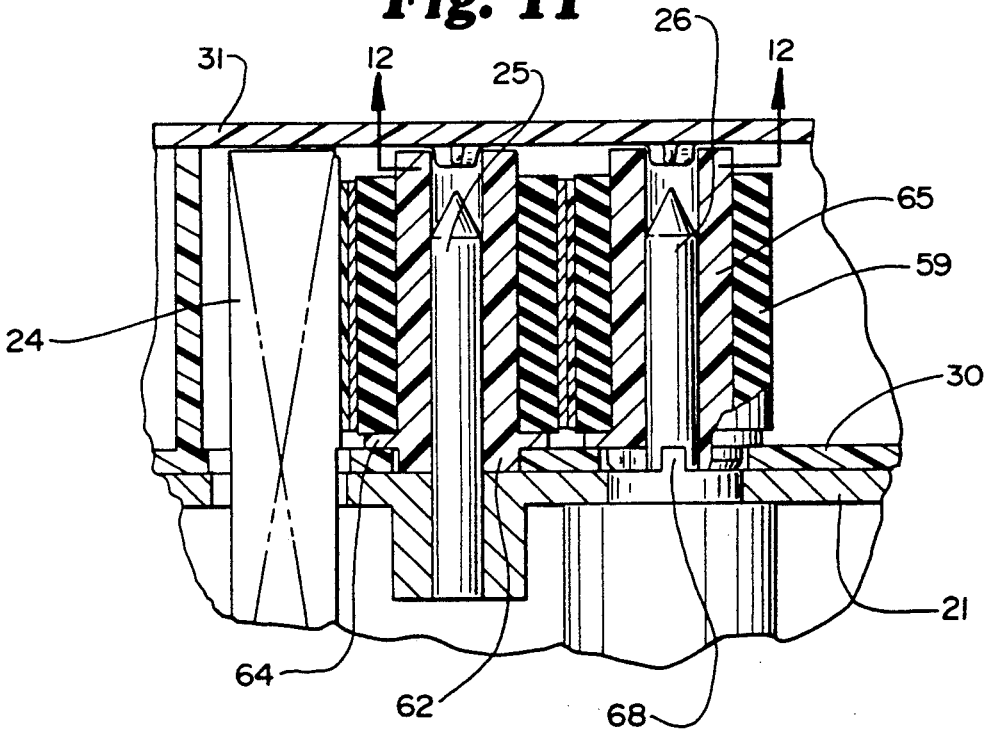
FIG. 11 is a fragmentary sectional diagram of the platen roller and lamination roller system.

With continuing reference to FIG. 11, the roller 59 is a driven roller which is mounted to the generally cylindrical sleeve 65. As illustrated best in FIG. 10, the bottom end of the sleeve 65 is provided with a plurality of drive notches 66. These notches 66 are adapted for engagement with a corresponding drive key 68 associated with the lamination alignment post 26. As illustrated in FIGS. 8, 9 and 11, the drive key 68 extends above the stage or bottom support surface 21 of the cartridge cavity for engagement with the notches 66 (FIG. 10) when the cartridge is inserted. To accommodate initial misalignment between the drive key 68 and the notches 66, the drive post 26 is depressable for a limited distance against the force of the compression spring 70 as illustrated in FIG. 9. A limited downward or depressing movement of the post 26 is also facilitated as a result of the center axle 71 extending through an opening in the frame portion 72 of the machine. The permissible downward or depressing movement of the post 26 is limited by a lower ring 73 connected with the axle 71. A spur gear 74 is connected with the drive post 26 to cause rotation of the same.

Figure 12:
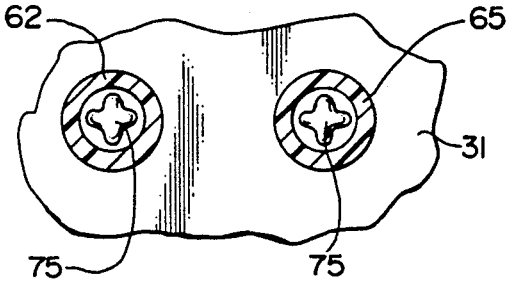
FIG. 12 is a bottom plan sectional view taken along the section line 12—12 of FIG. 11.

As illustrated best in FIGS. 11 and 12, both the platen roller 45 and the laminating drive roller 59 are mounted within the cartridge for limited movement relative to the other cartridge components. Such limited movement is facilitated as a result of the slight clearance between the bottom ends of the sleeves 62 and 65 and the corresponding openings in the cartridge base 30 and between the upper ends of the sleeves 62 and 65 and the alignment end guides 75. This slight clearance permits the position of the platen roller 45 and the lamination roller 59 to be finally adjusted and determined by the respective idler and drive posts 25 and 26. In this respect it should be noted that posts 25 and 26 are laterally fixed relative to the machine and the cartridge cavity support surface 21 to provide a consistent alignment of the platen roller 45 and the lamination roller 59 despite the particular cartridge being utilized. The fact that the alignment posts 25 and 26 provide for final alignment also permits additional tolerances in manufacturing of the cartridge. It should be noted that each of the parts 25 and 26 is tapered at its upper end to facilitate insertion into the sleeves 62 and 65, respectively.

Figure 13:
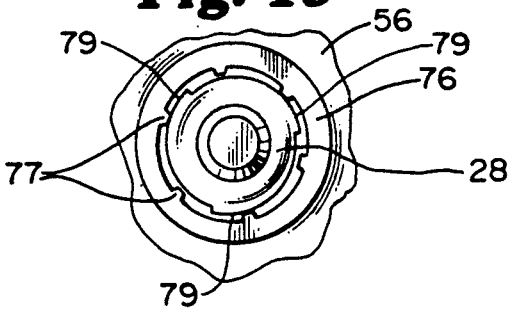
FIG. 13 is a fragmentary top plan view of the ribbon takeup roller.
Figure 15:
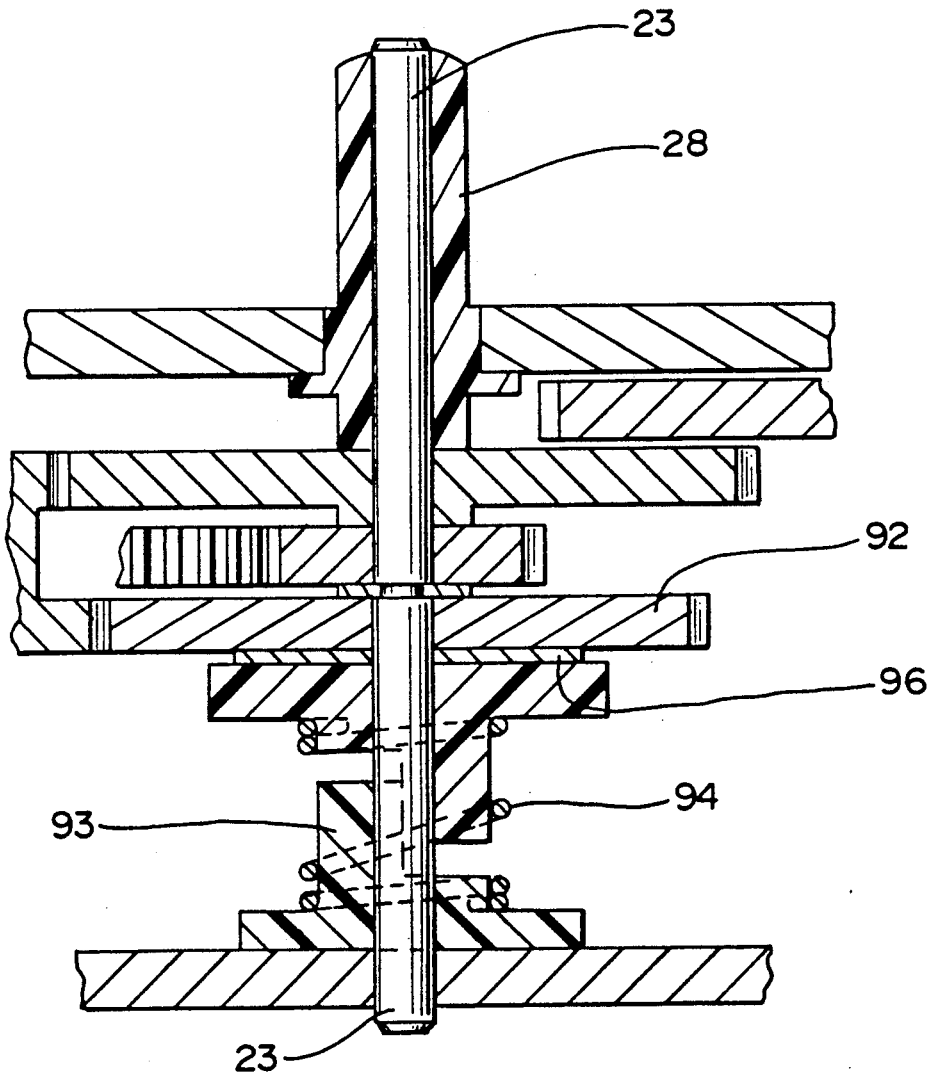
FIG. 15 is a sectional view illustrating the ribbon rewind shaft and the override feature related thereto.

The ribbon takeup spool is provided with an internal hub 76 which is supported by and rotates with the center shaft 23 and associated spindle 28 as illustrated best in FIG. 13 and 15. The hub 76 includes a plurality of inwardly extending ribs or dogs 77 which are mechanically engaged by a plurality of pawls 79 on spindle 28. As shown best in FIG. 15, the drive shaft 23 and spindle 28 are driven by an appropriate gear assembly 92 through an override motion transfer mechanism comprised of a friction pad 96, a split spool mechanism 93 and a compression spring 94. This override mechanism is needed because of the fact that the gear assembly 92 needs to rotate faster than the tape speed to insure that used ribbon is taken up but not pulled through at a faster rate than tape. In the preferred embodiment, rotational movement of the gear assembly 92 is transferred to the split spool 93 via the friction pad 96. Rotational movement of the spool 93 is then transferred to the shaft 23 by the press fit to 23. The compression spring 94 provides the bias which controls the transfer force. When sufficient resistance to rotation of the shaft 23 occurs, a slippage occurs between the gear assembly 92 and the pad 96.

Figure 5:
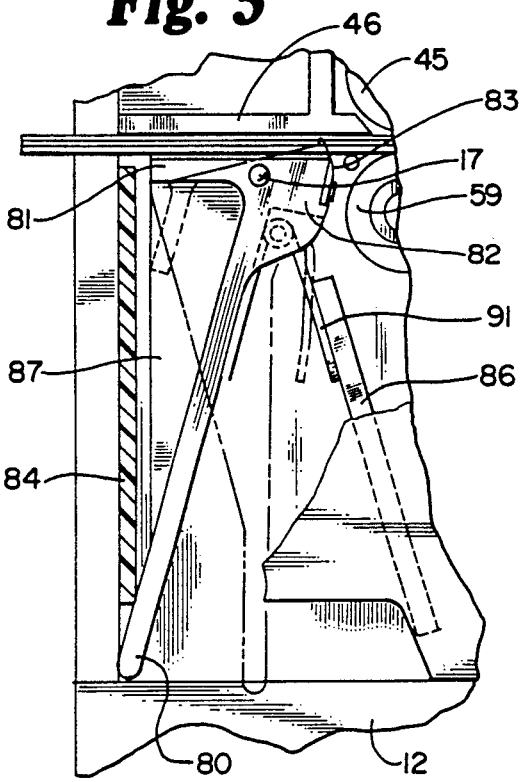
FIG. 5 is a slightly enlarged fragmentary top plan view of a portion of FIG. 4, with portions broken away showing the tape cut-off mechanism.

The details of the tape cut-off feature are illustrated best with reference to FIGS. 3, 4 and 5. As noted, this tape cut-off mechanism is manually operated, is embodied solely within the cartridge and is independent of any machine function. The tape cut-off mechanism includes a tape cut-off or trimmer lever 80 which is pivoted between the base 30 and cover 31 about an axis generally perpendicular thereto. Specifically, as illustrated in FIG. 2, the base 30 and cover 31 are each provided with a pivot opening 13 which is designed to receive a pivot post 17 integrally formed with the tape cut-off lever 80. Integrally formed with an inward end of the cut-off lever 80 is a blade carrying portion 82 to which a tape cutting plate 83 is secured. The tape cutting blade 83 includes a sharp razor edge extending generally perpendicular to the base 30 and cover 31 of the cartridge as illustrated. Also integrally formed with an inner portion of the cut-off lever 80 is a rearward wall 81 and web section 87 to provide the necessary rigidity and strength to the cut-off mechanism.

As illustrated best in FIG. 5, the cut-off lever 80 is pivotally movable between a retracted, noncutting position illustrated by solid lines in FIG. 5 and a manually actuated, cutting position illustrated by broken lines in FIG. 5. Such pivotal movement is about the pivot 17 as shown. An outward end of the cut-off lever 80 is accessible by the user's thumb or finger in order to manually rotate the cut-off mechanism in a cutting direction. The cut-off lever 80 is returned to its retracted, noncutting position, and is biased in that position, by a light torsion spring 91 acting between a portion of the lever 80 and a cartridge wall portion 86. The movement of the cut-off lever in a retracted, noncutting direction is limited as a result of engagement between an outer portion of the lever 80 and a side edge portion of the cover 31. When pivoted toward a cutting position the cutting action of the blade 83 is exerted against the backing wall portion 46.

Figure 6:
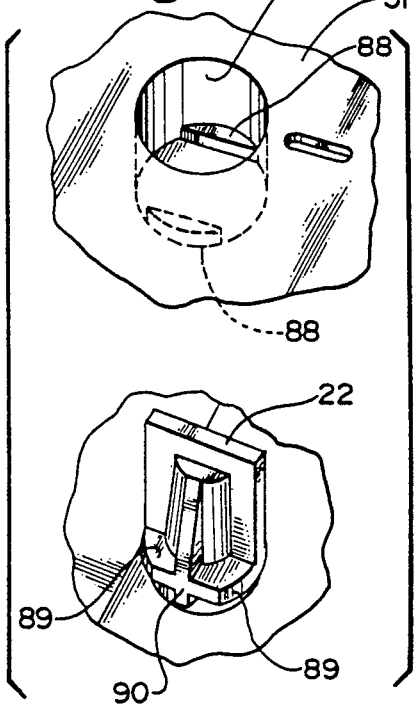
FIG. 6 is a fragmentary exploded view showing the means for locking the tape supply cartridge to the machine in an operative position.
Figure 7:
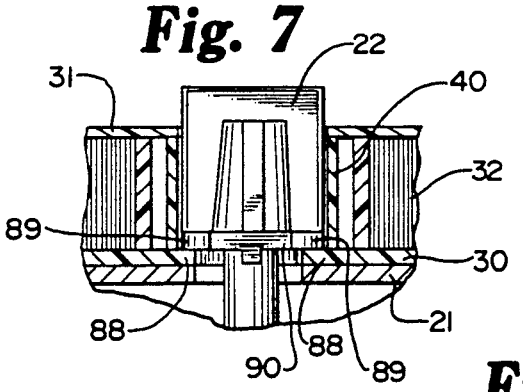
FIG. 7 is a fragmentary side elevational detail with the cartridge sectioned vertically on the central axis of the tape supply spool.

The mechanism for locking the cartridge 11 into an operative position within the cartridge cavity is illustrated best with reference to FIGS. 3, 4, 6 and 7. As shown in FIGS. 3 and 6, the lower end of the tape supply spool well 40 is provided with a pair of diametrically opposed lock ledges 88. These ledges 88 are selectively engageable by a pair of corresponding flanges 89 disposed on the lower end of the locking knob 22 when it is desired to lock the cartridge into an operative position. These flanges 89 are illustrated best in FIGS. 6 and 7. The lower end of the locking knob 22 is also provided with a pair of diametrically opposed flat surfaces 90 of reduced diametrical dimension which permits the cartridge to be inserted so that the top surface of the ledges 88 is positioned below the flanges 89. After such insertion, rotation of the locking key 22 through ninety degrees in a counter clockwise direction will cause the lower surface of the flanges 89 to engage the locking ledges 88 in the manner illustrated in FIG. 7. This retains the cartridge in its operative position.

Having described the structure of the machine and cartridge of the present invention in detail, the operation can be understood best as follows. First, prior to operation, a cartridge 11 is inserted into the machine. This can be done either with the cover 15 in its closed position as illustrated in FIG. 1 or in its open position as illustrated in FIG. 2. The cartridge 11 is then positioned over the cartridge cavity so that the tape supply spool well 40 is aligned with the locking knob 22 and the sleeves 62 and 65 (FIG. 11) are aligned with the posts 25 and 26. The cartridge is then lowered into the cartridge cavity. During this cartridge insertion step, the locking knob 22 is in the position illustrated in FIG. 2. After the cartridge 11 has been fully inserted, the locking knob 22 is rotated ninety degrees to the position illustrated in FIG. 1. This rotation also positions the printhead 24 relative to the platen 45. The machine is then ready for operation.

Although the description of the preferred embodiment has been quite specific, it is contemplated that various modifications could be made without deviating from the spirit of the present invention. Accordingly, it is contemplated that the scope of the present invention be dictated by the appended claims rather than by the description of the preferred embodiment.

I claim:

1. A tape supply cartridge for operative insertion into and use with a thermal printing device or the like having cartridge receiving and alignment means, a platen alignment post and a printhead, said cartridge comprising:

a cartridge housing having top and bottom walls and an end wall joining said top and bottom walls;

a printhead opening in one of said top and bottom walls;

a tape opening in a portion of said end wall;

a supply of tape;

a printing platen disposed between and mounted for limited alignment positioning relative to, said top and bottom walls and adapted for alignment relative to said platen alignment post, said platen cooperating with said printhead to define a print station for generating printed characters on said tape; and guide means for guiding said tape past said print station.

2. The tape supply cartridge of claim 1 wherein said platen is a cylindrical platen roller rotatable about said platen alignment post and said guide means further guides said tape around a portion of said platen roller.

3. The tape supply cartridge of claim 2 including a supply of lamination material and a lamination roller positioned between said top and bottom walls and adjacent to said platen roller for providing lamination material onto said tape to protect said printed characters.

4. The tape supply cartridge of claim 3 wherein said thermal printing device includes a lamination roller alignment post and wherein said lamination roller is mounted for limited alignment positioning movement relative to said top and bottom walls and is adapted for alignment relative to and rotation about said lamination roller alignment post.

5. The tape supply cartridge of claim 4 wherein said platen roller is an idler roller.

6. The tape supply cartridge of claim 5 wherein said lamination roller is a driven roller.

7. The tape supply cartridge of claim 1 including a first opening in one of said top and bottom walls to provide alignment access between said platen roller and said platen roller alignment post.

8. The tape supply cartridge of claim 4 including first and second openings in one of said top and bottom walls to provide alignment access between said platen roller and said platen roller alignment post and between said lamination roller and said lamination roller alignment post, respectively.

9. The tape supply cartridge of claim 1 including a ribbon supply and means for guiding said ribbon into printing alignment at said print station.

10. The tape supply cartridge of claim 9 including a take-up ribbon means and means for guiding said ribbon from said print station to said take-up ribbon means.

11. The tape supply cartridge of claim 1 including a manually actuated tape cut-off means pivotally supported between said top and bottom walls for severing a printed portion of said tape.

12. The tape supply cartridge of claim 11 wherein said tape cut-off means includes a tape cut-off backing wall and a cutting blade movable as a result of pivoting said cut-off means between a retracted, non-cutting position and an actuated, cutting position toward said backing wall.

13. The tape supply cartridge of claim 12 including a manually accessible arm for manually pivoting said cut-off means to said actuated, cutting position.

14. The tape supply cartridge of claim 13 including spring means for biasing said cut-off means toward a retracted, non-cutting position.

15. The thermal printing device of claim 14 wherein said platen alignment post is rigidly secured to said device housing.

16. The thermal printing device of claim 14 including an integral keyboard and a hinged cover movable between a non-operative position covering said keyboard and an operative position in which said keyboard is accessible.

17. A thermal printing device comprising:

a device housing;

an associated keyboard;

a cartridge receiving cavity having a bottom cartridge support surface;

a thermal printhead extending above said support surface;

a platen alignment post;

a tape supply cartridge including:

a cartridge housing having top and bottom walls and an end wall joining said top and bottom walls;

a printhead opening in one of said top and bottom walls;

a tape opening in a portion of said end wall;

a supply of tape;

a platen disposed between and mounted for limited alignment positioning relative to, said top and bottom walls and adapted for alignment relative to said platen alignment post, said platen cooperating with said printhead to define a print station for generating printed characters on said tape;

means for guiding said tape past said print station and around a portion of said platen; and means for retaining said tape supply cartridge in operative position within said cartridge receiving cavity.

18. The thermal printing device of claim 17 wherein said platen is a cylindrical platen roller rotatable about said platen alignment post and said guide means further guides said tape around a portion of said platen rollers.

* * * * *